US006801633B2

(12) United States Patent
Tracy

(10) Patent No.: US 6,801,633 B2
(45) **Date of Patent: *Oct. 5, 2004**

(54) SUBWOOFER ASSEMBLY

(76) Inventor: Dennis A. Tracy, 11136 Washington Blvd., Culver City, CA (US) 90232

( * ) Notice: Subject to any disclaimer, the term of this patent is extended or adjusted under 35 U.S.C. 154(b) by 123 days.

This patent is subject to a terminal disclaimer.

(21) Appl. No.: 09/768,468

(22) Filed: Jan. 25, 2001

(65) Prior Publication Data

US 2002/0097888 A1 Jul. 25, 2002

(51) Int. Cl.[7] ..... H04R 25/00

(52) U.S. Cl. ..... 381/389; 381/86; 381/302; 381/338; 181/141; 181/156

(58) Field of Search ..... 381/86, 302, 345, 381/165, 166, 338, 339, 389, 386, 395, 365; 181/156, 141, 150; 24/495; 248/27.1, 525

(56) References Cited

U.S. PATENT DOCUMENTS 3,789,164 A * 1/1974 Ryder ..... 381/382
6,237,715 B1 * 5/2001 Tracy ..... 181/156
6,463,160 B1 * 10/2002 Tracy ..... 381/386

* cited by examiner

*Primary Examiner*—Suhan Ni
(74) *Attorney, Agent, or Firm*—Welsh & Flaxman LLC

(57) ABSTRACT

A subwoofer assembly for use within an aircraft including a fuselage having a passenger platform, wherein the passenger platform includes an aisle and a seating area. The subwoofer assembly is shaped and dimensioned for positioning under the aisle. The subwoofer assembly includes a subwoofer housing having a profile shaped to substantially conform to a position beneath the passenger platform under the aisle. The subwoofer housing includes a sound port through which sound is delivered from the subwoofer assembly to a passenger compartment of the aircraft. The subwoofer assembly further including a sound driver mounted within the subwoofer housing for generating predetermined sounds.

14 Claims, 5 Drawing Sheets

SUBWOOFER ASSEMBLY

BACKGROUND OF THE INVENTION

1. Field of the Invention

The invention relates to subwoofer assemblies. More particularly, the invention relates to a subwoofer assembly shaped and dimensioned for mounting under the center aisle of an aircraft.

2. Description of the Prior Art

The current global community has made it possible for people from around the country, and around the world, to interact for both business and personal reasons. For many people, this requires that they spend considerable time traveling from one location to another location. More often than not, these people travel in aircraft.

Whether these people travel in private or commercial aircraft, they desire high quality entertainment during the many hours they spend within the confines of an aircraft. However, while high quality entertainment, for example, digital video with CD quality sound, is readily available for theater and home use, the weight and size requirements for use in aircraft make it very difficult to incorporate high fidelity systems within an aircraft. This problem is especially pronounced for audio speaker assemblies when one attempts to meet the size, weight and shape requirements necessary for use in aircraft.

The aircraft industry places great priority upon component weight and size reductions. In addition, spacing and positioning of speaker assemblies is of great importance to those optimizing the operation of aircraft. The size, weight and shape of conventional terrestrial speaker assembly designs adversely affect range and payload. These concerns are notable when one attempts to make changes within smaller private jets. For example, a small increase in the weight carried by an aircraft results in a substantial increase in the fuel consumption of the aircraft. In addition, the limited space available within an aircraft dictates the use of any space within the aircraft be carefully considered by those responsible for ensuring the comfort of passengers.

Lightweight and compact audio speakers are currently available. These speakers, however, substantially compromise sound quality for reductions in size and weight. An individual wishing to add an audio system to an aircraft must make a choice between high fidelity speakers not suiting the size and weight requirements of the aircraft and lower quality speakers providing desirable size and weight characteristics.

The weight and size problems associated with the use of loudspeaker systems within aircraft are very evident when one attempts to incorporate woofers into an aircraft design. Conventional woofers employ substantial housings designed to control the manner in which sound is transmitted from the woofer. The controlled porting of sound employed in conventional woofers necessitates the construction of rather substantial housings. These housings, while controlling the transmission of sound as desired, are commonly beyond the size and weight constraints required for use within an aircraft.

A need, therefore, exists for a speaker assembly providing high fidelity sound, while also meeting the size and weight requirements of an aircraft. The present invention provides such a speaker assembly.

SUMMARY OF THE INVENTION

It is, therefore, an object of the present invention to provide an aircraft including a fuselage having a passenger platform, wherein the passenger platform includes an aisle and a seating area. The aircraft further includes at least one subwoofer assembly mounted beneath the passenger platform under the aisle. The subwoofer assembly is shaped and dimensioned for positioning under the aisle. The subwoofer assembly includes a subwoofer housing having a profile shaped to substantially conform to a position beneath the passenger platform under the aisle. The subwoofer housing includes a sound port through which sound is delivered from the subwoofer assembly to a passenger compartment of the aircraft. The subwoofer assembly further including a sound driver mounted within the subwoofer housing for generating predetermined sounds.

It is also an object of the present invention to provide an aircraft including a sound tube coupled to the sound port for directing sound to the passenger compartment of the aircraft.

It is another object of the present invention to provide an aircraft wherein the sound tube is adjustably coupled to the sound port in a manner permitting relative movement.

It is a further object of the present invention to provide an aircraft wherein a wall links the aisle to the seating area and the wall includes an opening through which sound from the subwoofer assembly is directed.

It is also another object of the present invention to provide an aircraft including a sound tube coupled to the sound port for directing sound to the passenger compartment of the aircraft, wherein the sound tube includes a proximal end coupled to the sound port and a distal end coupled adjacent the opening in the wall.

It is yet another object of the present invention to provide an aircraft wherein the aisle is a center aisle and seating areas are positioned on opposite sides of the center aisle.

It is still a further object of the present invention to provide an aircraft wherein the subwoofer housing is made from aluminum.

It is also an object of the present invention to provide a method for positioning a subwoofer assembly within an aircraft including a passenger platform, the passenger platform including an aisle and a seating area. The method is achieved by mounting a subwoofer assembly beneath the passenger platform under the aisle such that the subwoofer is hidden from the view of a passenger compartment of the aircraft and directing sound from the subwoofer to the passenger compartment of the aircraft.

It is another object of the present invention to provide a subwoofer assembly including a subwoofer housing having a sound port through which sound is delivered from the subwoofer assembly to a passenger compartment of the aircraft, a sound driver mounted within the subwoofer housing for generating predetermined sounds, and a relatively adjustable sound tube selectively coupled to the sound port.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
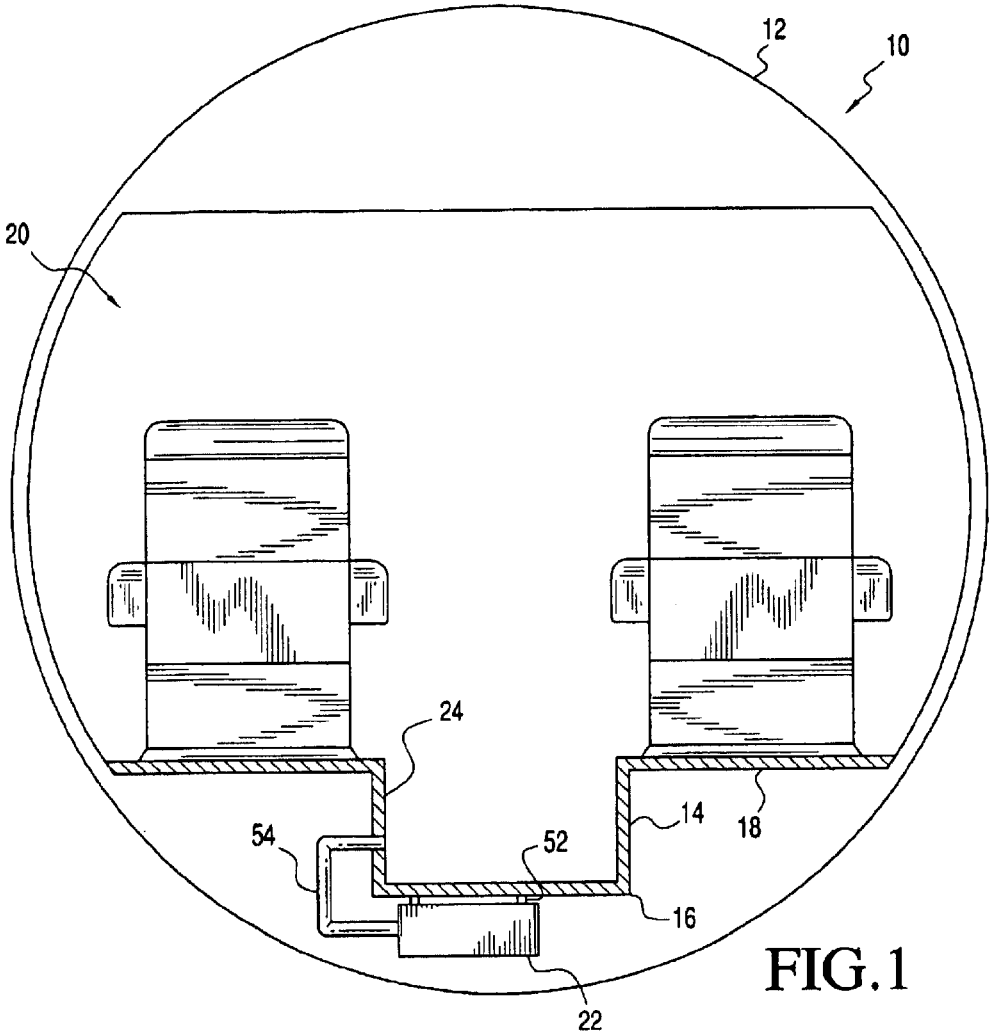
FIG. 1 is a cross sectional view of an aircraft employing the present subwoofer assembly.
Figure 2:
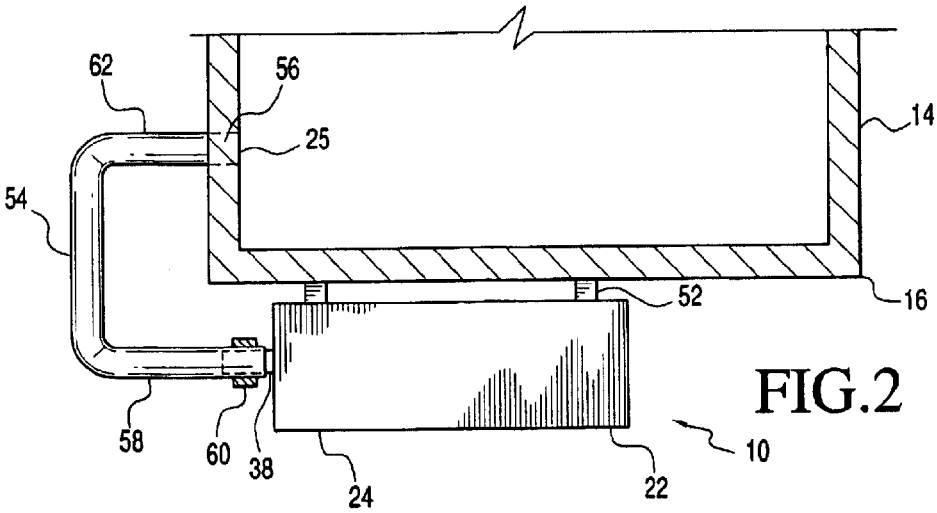
FIG. 2 is a detailed cross sectional view of the subwoofer assembly installation in accordance with the present invention.

Referring to FIGS. 1 and 2, the general construction of an aircraft 10 contemplated for use in accordance with the present invention is shown. In accordance with a preferred embodiment of the present invention, the present subwoofer assembly is adapted for use in business class jet aircraft, although those skilled in the art will readily appreciate the many applications within the scope of the present invention. Most business jet aircraft are of low-wing design and have engines mounted at the aft end of the fuselage 12. Like any aircraft, the size and performance of business jets vary with the function for which the aircraft has been designed. Aircraft are available that vary in gross weight from about 11,000 to 65,000 pounds. Cruising speeds lie in the range from 0.7 to 0.85 Mach number. Ranges vary from intercontinental values to as low as 1150 miles. Many of the new aircraft being produced have at least nonstop transcontinental capability. The number of passengers that can be accommodated, even on aircraft of the same design, varies widely depending on the interior cabin arrangements; for example, aircraft can be found with the capability of carrying from 5 to 19 passengers.

The small size of many business jets imposes certain design constraints not encountered in large transport aircraft. One dimension that cannot be scaled as the size of an aircraft is reduced is the size of the human body that occupies the cabin. This essentially invariant dimension is usually a predominant factor in determining the fuselage diameter. A small fuselage diameter is desirable to reduce weight and maintain as low a value of the ratio of wetted area to wing area as possible. Accordingly, only very large business jets have a cabin diameter sufficiently large to accommodate a person standing in an upright position. A cabin free of obstructions is a desirable feature intended to improve passenger comfort while also reducing the possibility of a passenger tripping or falling.

With this in mind, the passenger platform 14 of the aircraft 10 is generally formed with the center aisle 16 sunken to take full advantage of the fuselage diameter while the passenger is standing. Similarly, the elevated positioning of the seating area 18 substantially along the horizontal diameter of the fuselage 12 takes full advantage of the fuselage diameter while the passengers are seated.

Manufacturers generally desire to limit modifications to the passenger compartment 20 to only required modifications. As such, the present invention takes advantage of the unused space beneath the center aisle 16 by positioning a subwoofer assembly 22 under the passenger platform 14 at the center aisle 16 and porting the sound through the recessed sidewalls 25 linking the seating area 18 with the center aisle 16.

Figure 3:
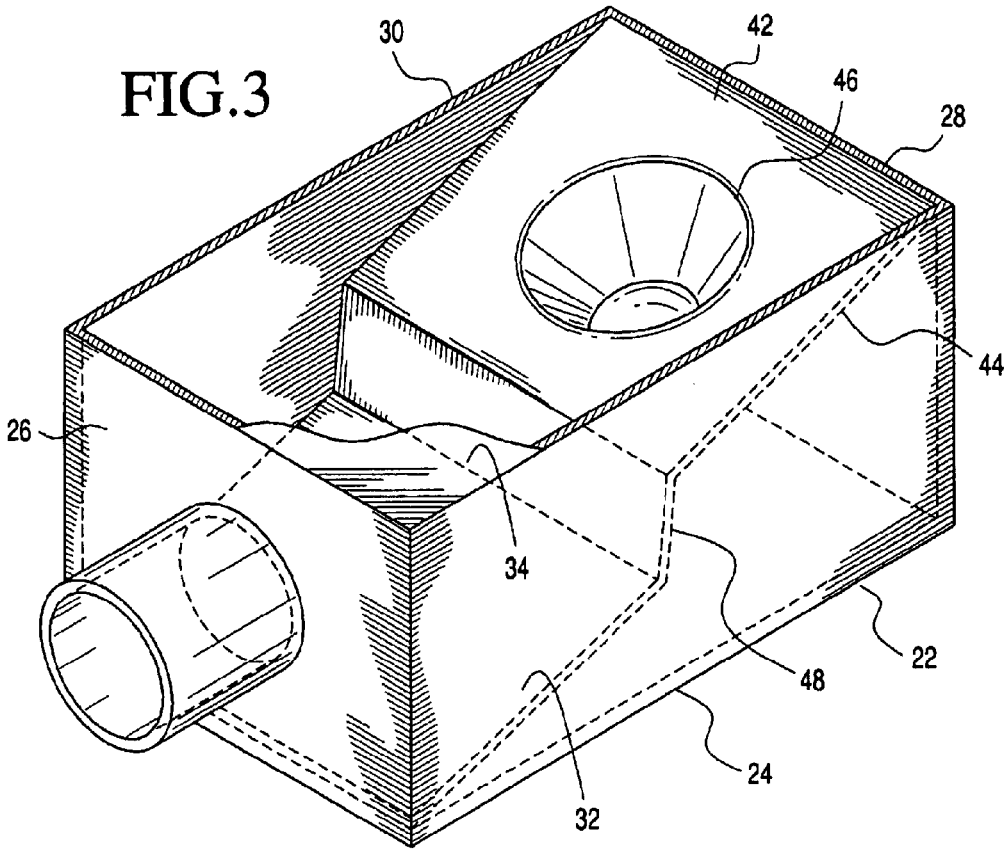
FIG. 3 is perspective view of a subwoofer in accordance with the present invention.
Figure 4:
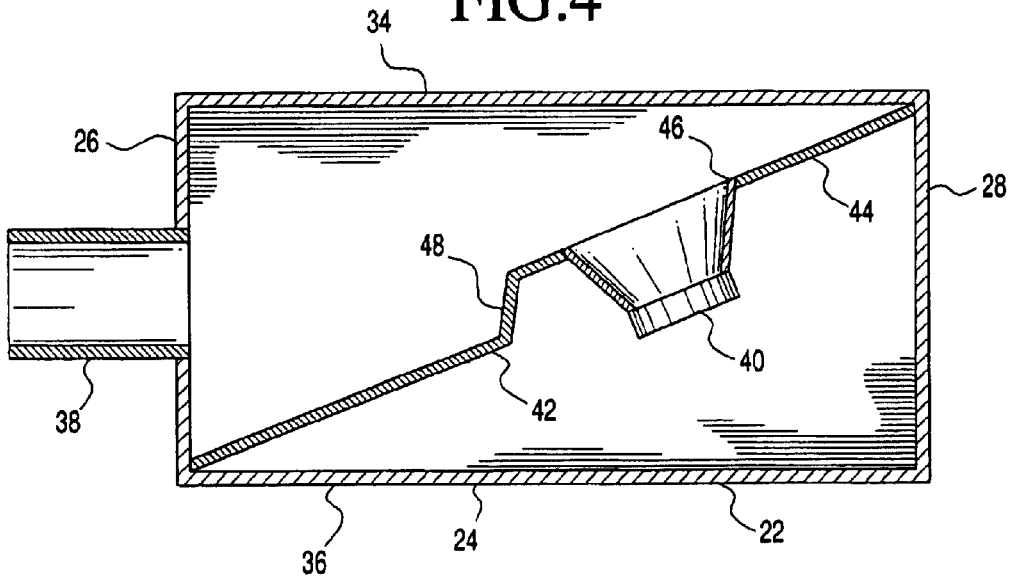
FIG. 4 is a cross sectional view of a subwoofer in accordance with the present invention.

With particular reference to FIGS. 2, 3 and 4, the subwoofer assembly 22 in accordance with the present invention is disclosed. The subwoofer assembly 22 includes a subwoofer housing 24 shaped and dimensioned to fit beneath the center aisle 16 of the passenger platform 14 formed within an aircraft fuselage 12 (see FIGS. 1 and 2). Specifically, the subwoofer housing 24 is shaped and dimensioned to fit beneath the center aisle 16 of the passenger platform 14. The subwoofer housing 24 is preferably made of lightweight materials. For example, the housing 24 is preferably made from aluminum, although other materials may be employed without departing from the spirit of the present invention.

The subwoofer housing 24 includes a front wall 26 and a rear wall 28 connected by first and second lateral sidewalls 30, 32, a top sidewall 34 and a bottom sidewall 36. Sound generated by the subwoofer assembly 22 is directed from the subwoofer housing 24 through a sound port 38 formed in the front wall 26 of the subwoofer housing 24. The sound port 38 of the present subwoofer housing 24 is substantially oval shaped, although other shapes may be employed without departing from the spirit of the present invention.

The internal structure of the subwoofer assembly 22 is composed of a low frequency driver 40 mounted on a sound baffle 42 extending from the top sidewall 34/rear wall 28 to the bottom sidewall 36/front wall 26 within the subwoofer housing 24. The sound generated by the subwoofer assembly 22 is enhanced by the provision of an angled sound baffle 42 within the subwoofer housing 24. The sound baffle 42 is angled as it extends from the top sidewall 34/rear wall 28 of the subwoofer housing 24 to the bottom sidewall 36/front wall 26 of the subwoofer housing 24 to create a sound space which expands as the sound baffle 42 extends from the top sidewall 34 of the subwoofer housing 24 to the bottom sidewall 36 of the subwoofer housing 24. The sound baffle 42 controls transmission of sound from the driver to the sound port 38 in a manner optimizing the generated sound.

Specifically, the sound baffle 42 includes a first baffle section 44 extending from the top sidewall 34/rear wall 28 of the subwoofer housing 24 to a central section of the subwoofer housing 24. The driver 40 is mounted within an opening 46 formed in the first baffle section 44 of the sound baffle 42. The driver 40 preferably works in a standard subwoofer frequency range, although drivers functioning in different ranges may be used without departing from the spirit of the invention. The driver 40 includes standard sound source connections and may include crossover circuitry if so desired for the final sound system configuration.

The sound space created by the first baffle section 44, that is, the space between the first baffle section 44 and the top sidewall 34 of the subwoofer housing increases as the first baffle section 44 extends from the top sidewall 34 of the subwoofer housing 24 toward the central section of the subwoofer housing 24. A second baffle section 48 couples the first baffle section 46 to a third baffle section 50, which extends from the central section to the bottom sidewall 36/front wall 26 of the subwoofer housing 24.

The second baffle section 48 extends away from the top sidewall 34 and rear wall 28 of the subwoofer housing 34, and increases the spacing between the top sidewall 34 of the subwoofer housing 34 and the third baffle section 50. As with the first baffle section 44, the sound space created by the third baffle section 50 and the top sidewall 34 of subwoofer housing 24 increases as the third baffle section 50 extends from the central section of the subwoofer housing 24 toward the bottom sidewall 36 of the subwoofer housing 24.

As shown in FIGS. 1 and 2, and as briefly discussed above, the subwoofer assembly 22 is mounted under the center aisle 16 within the aircraft fuselage 12. Specifically, the subwoofer housing 24 is bolted to existing support structures 52 located beneath the center aisle 16. A sound tube 54 links the sound port 38 to an opening 56 formed in the sidewall 25 linking the center aisle 16 to the seating area 18. The proximal end 58 of the sound tube 54 is shaped and dimensioned to telescopically receive the sound port 38 of the subwoofer housing 24. Once the sound tube 54 is properly position on the sound port 38, a clamp 60 is secured about the sound tube 54 and tightened to frictionally couple the sound tube 54 to the sound port 38 in a desired manner. The efficiency of this positioning allows the subwoofer assembly 22 to be incorporated within an aircraft 10 without compromising the interior design of the passenger compartment 20.

This two-piece construction improves installation by permitting stepwise installation without the necessity of installing the entire assembly in a single piece. In addition, the adjustable telescoping coupling utilized in connecting the sound tube 54 to the sound port 38 permits the present subwoofer assembly 22 to be readily adapted for positioning at various locations along center aisle 16 (i.e., where the distance the sound tube must extend to reach a sidewall varies) and within differing aircraft.

Generally, the subwoofer assembly 22 is mounted such that the sound port in the sidewall extends along the center aisle under the passenger support. The sound tube 54 couples the sound port 38 to the passenger compartment 20 of the aircraft 10. Specifically, the proximal end 58 of the sound tube 54 is coupled to the sound port 38 of the subwoofer housing 24 and the distal end 62 of the sound tube 54 is coupled adjacent the opening 56 in the wall 25 to direct sound to the passenger compartment 20 of the aircraft 10.

The distal end 62 of the sound tube 54 is mounted flush with the conforming opening 56 formed in the wall 25 linking the center aisle 16 to the seating area 18 within the passenger compartment 20 to direct sound therein. The distal end 62 of the sound tube 54 may be covered to conform to the interior decor of the aircraft 10 and hide the port through which the sound enters the passenger compartment of the aircraft.

Figure 5:
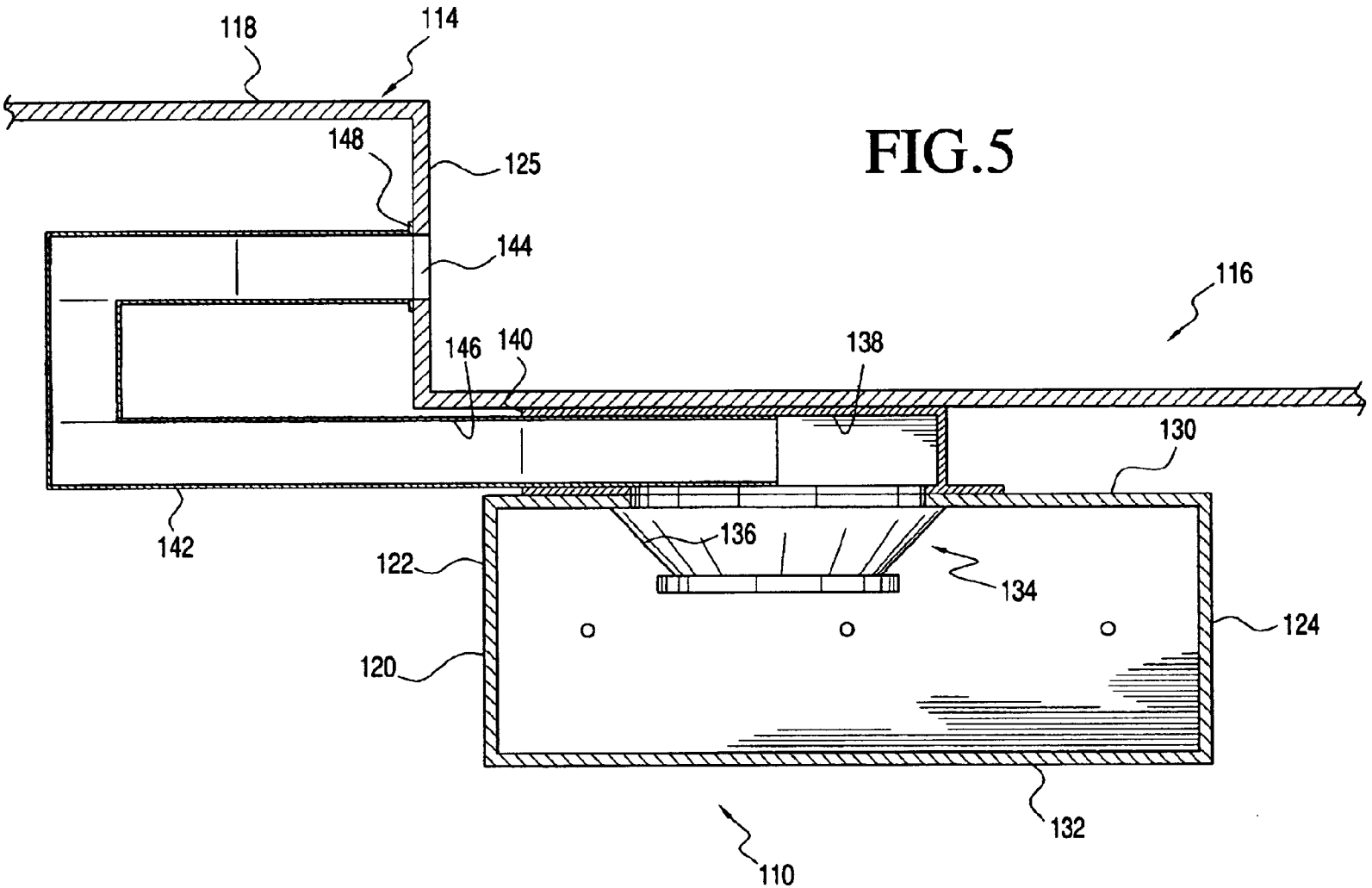
FIG. 5 is a side a cross sectional view of an alternate embodiment of a subwoofer assembly in accordance with the present invention.
Figure 6:
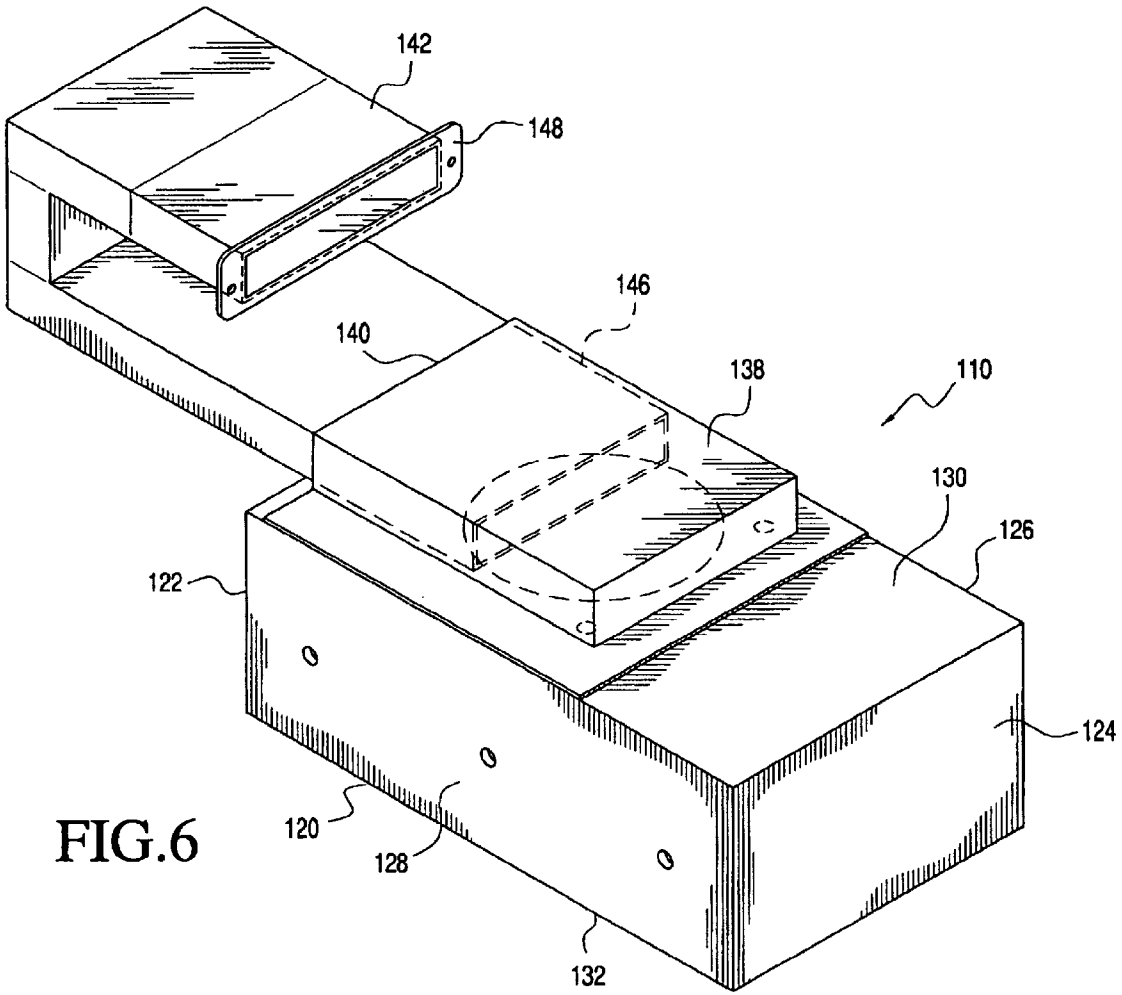
FIG. 6 is a perspective view of the subwoofer assembly shown in FIG. 5.
Figure 7:
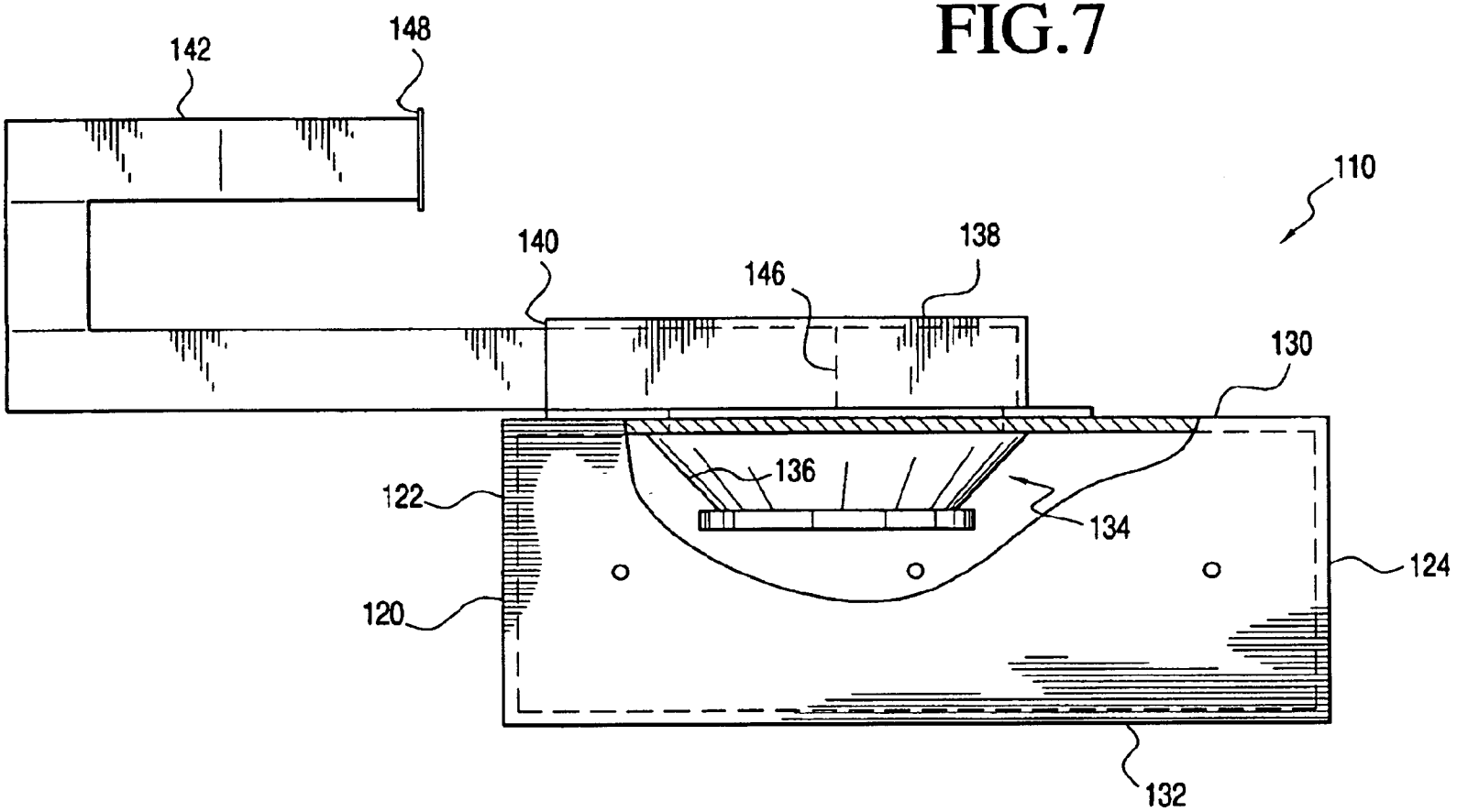
FIG. 7 is a side view of the subwoofer assembly shown in FIG. 5.

An alternate embodiment of the present invention is disclosed in FIGS. 5, 6 and 7. As with the embodiment previously described, this embodiment is adapted for placement within the unused space beneath the center aisle 116; that is, the subwoofer assembly 110 is positioned under the passenger platform 114 at the center aisle 116 and ports the sound through the recessed sidewalls 125 linking the seating area with the center aisle 116.

With particular reference to FIG. 5, the subwoofer assembly 110 in accordance with the present invention is disclosed. The subwoofer assembly 110 includes a subwoofer housing 120 shaped and dimensioned to fit beneath the center aisle 116 of the passenger platform 114 formed within an aircraft fuselage. The subwoofer housing 120 is preferably made of lightweight materials. For example, the housing 120 is preferably made from aluminum, although other materials may be employed without departing from the spirit of the present invention.

The subwoofer housing 120 includes a front wall 122 and a rear wall 124 connected by first and second lateral sidewalls 126, 128, a top sidewall 130 and a bottom sidewall 132. A low frequency driver 134 is mounted to the top sidewall 130 with the cone 136 of the driver 134 directed through an opening in the top sidewall 130 away from the housing 120. A cover plate 138 is positioned over the cone 136 and substantially encloses the cone 136. However, sound generated by the driver is passed from within the cover plate 138 through a sound port 140 formed in the sidewall of the coverplate 138. While a preferred embodiment of the present invention provides a substantially empty subwoofer housing, various baffles and acoustic elements may be positioned within the internal structure of the subwoofer housing without departing from the spirit of the present invention.

A sound tube 142 couples the sound port 140 of the subwoofer assembly 110 to the passenger compartment of an aircraft. Specifically, and with reference to FIG. 5, the subwoofer assembly 110 is mounted under the center aisle 116 within the aircraft fuselage. The subwoofer housing 110 is bolted to existing support structures located beneath the center aisle 116. The sound tube 142 links the sound port 140 to an opening 144 formed in the sidewall 125, linking the center aisle 116 to the seating area 118. The proximal end 146 of the sound tube 142 is shaped and dimensioned to be telescopically received within the sound port 140 of the cover plate 138. Once the sound tube 142 is properly position within the sound port 140, a frictional grommet (not shown) is positioned between the sound port 140 and the sound tube 142. The grommet holds the sound tube 142 relative to the subwoofer housing 120 while also sealing the space between the sound port 140 and the sound tube 142. The efficiency of this positioning allows the subwoofer assembly 110 to be incorporated within an aircraft without compromising the interior design of the passenger compartment.

Generally, the subwoofer assembly 110 is mounted such that the sound tube 142 extends along the center aisle 116 under the passenger support 114. The sound tube 142 couples the sound port 140 to the passenger compartment of the aircraft. Specifically, the distal end 148 of the sound tube 142 is coupled adjacent the opening 144 in the wall 125 to direct sound to the passenger compartment of the aircraft.

The distal end 148 of the sound tube 142 is mounted flush with the conforming opening 144 formed in the wall 125, linking the center aisle 116 to the seating area 118 within the passenger compartment to direct sound therein. The distal end 148 of the sound tube 142 may be covered to conform to the interior decor of the aircraft and hide the port through which the sound enters the passenger compartment of the aircraft.

By porting the sound generated by the subwoofer assembly in the manner discussed above, the sound may enter the passenger compartment at any convenient location. The interior decor need not be altered to suit the positioning of the subwoofer assembly. As such, the interior remains intact, maintaining the noise insulation and structural stability provided by the interior panels.

In practice, multiple subwoofers are commonly mounted within an aircraft. The number of subwoofers employed is determined by the size of the aircraft and the needs of the aircraft owners. Those of ordinary skill in the art will certainly appreciate the need for specific positioning of the subwoofers within the aircraft to optimize the generated sound.

It is further contemplated that the exact shape of the subwoofer assembly may be varied to suit specific needs. For example, the unit could be wider than tall where the fuselage construction dictates such a design.

While the preferred embodiments have been shown and described, it will be understood that there is no intent to limit the invention by such disclosure, but rather, is intended to cover all modifications and alternate constructions falling within the spirit and scope of the invention as defined in the appended claims.

What is claimed is:

1. A subwoofer assembly mounted within an aircraft, the combined subwoofer assembly and aircraft comprising:

a fuselage including a passenger platform, the passenger platform including an aisle and a seating area;

at least one subwoofer assembly mounted beneath the passenger platform under the aisle, the subwoofer assembly being shaped and dimensioned for positioning under the aisle, wherein the subwoofer assembly includes;

a subwoofer housing including a profile shaped to substantially conform to a position beneath the passenger platform under the aisle, the subwoofer housing including a sound port through which sound is delivered from the subwoofer assembly to a passenger compartment of the aircraft, and a sound tube including a proximal end and a distal end, the proximal end of the sound tube is selectively coupled to the sound port and the distal end of the sound tube is attached to an opening within the passenger platform for directing sound into a passenger compartment of the aircraft in a manner permitting the transmission of sound to the passenger compartment of the aircraft without the need for redesigning the aircraft; and a sound driver mounted within the subwoofer housing for generating predetermined sounds.

2. A subwoofer assembly according to claim 1, wherein the sound tube is adjustably coupled to the sound port in a manner permitting relative movement.

3. A subwoofer assembly according to claim 1, wherein a wall links the aisle to the seating area, the wall including the opening through which sound from the subwoofer assembly is directed.

4. A subwoofer assembly according to claim 3, wherein the aisle is a center aisle and seating areas are positioned on opposite sides of the center aisle.

5. A subwoofer assembly according to claim 1, wherein the sound tube is adjustably coupled to the sound port in a manner permitting relative movement.

6. A subwoofer assembly according to claim 1, wherein the subwoofer housing is made from aluminum.

7. A method for positioning a subwoofer assembly within an aircraft including a passenger platform the passenger platform including an aisle and a seating area, comprising the following steps:

mounting a subwoofer assembly beneath the passenger platform under the aisle such that the subwoofer is hidden from the view of a passenger compartment of the aircraft;

coupling a sound tube between the subwoofer and an opening within the passenger platform to facilitate the transmission of sound to the passenger compartment of the aircraft without the need for redesigning the aircraft; and directing sound from the subwoofer through the sound tube and to the passenger compartment of the aircraft.

8. The method according to claim 7, wherein the sound tube is adjustably coupled to the sound port in a manner permitting relative movement, and the step of positioning includes adjusting the sound tube relative to the subwoofer for optimal positioning.

9. The method according to claim 7, wherein a wall links the aisle to the seating area, the wall including the opening through which sound from the subwoofer assembly is directed, and the step of directing includes directing sound from the subwoofer through the opening formed in the wall.

10. The method according to claim 7, wherein the subwoofer housing is made from aluminum.

11. A subwoofer assembly adapted for mounting beneath an aisle of an aircraft such that sound may be readily directed into a passenger compartment of an aircraft, comprising:

a subwoofer housing including a sound port through which sound is delivered from the subwoofer assembly to a passenger compartment of an aircraft, the subwoofer housing including means for mounting the subwoofer assembly beneath an aisle of an aircraft;

a sound driver mounted within the subwoofer housing for generating predetermined sounds; and a C-shaped sound tube including a proximal end and a distal end, the proximal end of the sound tube is selectively coupled to the sound port, the sound tube being relatively adjustable relative to the subwoofer housing, and the distal end of the sound tube is shaped and dimensioned for attachment to an aisle of an aircraft for directing sound into a passenger compartment of an aircraft, whereby the C-shaped sound tube in conjunction with the means for mounting facilitate mounting of the subwoofer assembly beneath an aisle of an aircraft in a manner permitting the transmission of sound to a passenger compartment of an aircraft without the need for redesigning the existing aircraft.

12. The subwoofer assembly according to claim 11, wherein the subwoofer housing is made of aluminum.

13. The subwoofer assembly according to claim 11, wherein the sound tube and the sound port are telescopically coupled.

14. The subwoofer assembly according to claim 11, further including a sound baffle on which the sound driver is mounted, the sound baffle extending from a top sidewall/rear wall of the subwoofer housing to the bottom sidewall/front wall of the subwoofer housing, wherein the sound baffle extends in such a way to increase the sound space within the subwoofer housing proximate the sound port.

* * * * *